United States Patent [19]

de Groot et al.

[11] Patent Number: 4,982,861

[45] Date of Patent: Jan. 8, 1991

[54] EXPLOSION-SAFE LIQUID CONTAINER

[75] Inventors: Johannes J. de Groot, Gorssel; Paul J. Sikkens, Zoetermeer, both of Netherlands

[73] Assignee: Akzo N.V., Arnhem, Netherlands

[21] Appl. No.: 246,227

[22] Filed: Sep. 19, 1988

[30] Foreign Application Priority Data

Sep. 21, 1987 [EP] European Pat. Off. ..... 87201802

[51] Int. Cl.[5] ..... B65D 25/00

[52] U.S. Cl. ..... 220/89.1; 220/5 A

[58] Field of Search ..... 220/89 A, 5 A, 1 B, 220/89.1

[56] References Cited

U.S. PATENT DOCUMENTS

| | | | |
|---|---|---|---|
| 3,239,095 | 3/1966 | Jones | 220/85 |
| 3,435,984 | 4/1969 | Damiani | 220/89 A |
| 3,945,941 | 3/1976 | Borchert et al. | 252/186 |
| 4,047,548 | 9/1977 | Wagner | 220/89 A X |
| 4,512,171 | 4/1985 | Mozley | 220/89 A X |

FOREIGN PATENT DOCUMENTS 1148334 6/1983 Canada .

149086 10/1902 Fed. Rep. of Germany .

OTHER PUBLICATIONS

"Safety Aspects of Organic Peroxides in Bulk Tanks," Jan de Groot, Dick Groothuizen, Jaap Verhoeff, *I&EC Process Design & Development*, 1981, pp. 131–138.

*Primary Examiner*—Steven M. Pollard

*Attorney, Agent, or Firm*—David H. Vickrey; Louis A. Morris

[57] ABSTRACT

The present disclosure relates to a container adapted for holding liquid compounds liable to exothermic decomposition, said container provided with at least one explosion-safe liquid release system comprised of a conduit having an inlet and an outlet, wherein said inlet is located at the bottom of said container. Containers provided with such explosion-safe liquid release systems are particularly suitable for use with organic peroxides. Also disclosed are methods for storing or transporting liquid compounds liable to exothermic decomposition in containers of the present disclosure. Containers used in such methods may optionally hold inert particles and/or liquid diluents.

11 Claims, 1 Drawing Sheet

EXPLOSION-SAFE LIQUID CONTAINER

The present invention relates to a container adapted for holding liquid compounds liable to exothermic decomposition, said container provided with at least one explosion-safe liquid release system wherein said liquid release system is operated by pressure less than the maximum pressure rating of said container, said liquid release system comprised of a conduit having an inlet and an outlet.

BACKGROUND OF THE INVENTION

Liquid compounds liable to exothermic decomposition decompose above certain critical temperatures to produce gas and heat. The heat produced further promotes the decomposition. Such compounds, and solutions, dilutions, suspensions, and emulsions containing such compounds, are thus referred to as "self-heating" or "exothermically decomposing compounds." Examples of such compounds are liquid organic peroxides with explosive properties, such as tert.-butyl perxoybenzoate, tert.-butyl peroxypivalate (up to 77% in solution), tert.-butyl peroxy-2-ethylhexanoate and tert.-butyl peroxy isopropylcarbonate (up to 77% in solution); other organic peroxides, such as 2,5-dimethyl 2,5 ditert.-butyl peroxyhexane, tert.-butyl peroxy acetate (up to 52% in solution), di(3,5,5trimethyl hexanoyl) peroxide (not more than 77% in solution), and methyl ethyl ketone peroxides (not more than 40% in diisobutyl nylonate); inorganic peroxides, such as hydrogen peroxide, ammonium peroxydisulphate, alkaliperborates. alkalipercarbonates, ammonium peroxymonosulphate, alkaline earth peroxyborates, and alkaline earth persulphates; azo compounds, such as 2,2'-azo di-(2,4-dimethyl)valeronitrile 50% in methylethylketone; nitrate compounds, such as 2-ethyl-hexylnitrate; nitrile compounds, such as pentylnitrite; and sulphohydrazides, such as benzenesulphohydrazide, N-nitroso compounds, nitro compounds and organic nitrates.

The storage and transportation of exothermic decomposition compounds are particularly troublesome in that the build-up of decomposition gases in the transportation or storage container may cause violent, hazardous explosions, bursting the container holding the compounds. In recognition of this problem, international safety laws and standards regulate the size and construction of containers used to store and transport such compounds. For example, the standards of the UN publication "Recommendations on the Transport of Dangerous Goods" limit the transportation of certain liquid organic peroxides to 50 kg plastic containers. International regulations for the transportation of organic peroxides are also contained in the "European Agreement Concerning the International Carriage of Dangerous Goods by Road" (ADR) and the "International Code for the Transport of Dangerous Goods by Ship" (IMDG-code).

These and other limitations on container design and compound concentration hamper the efficient storage and transportation of compounds liable to exothermic decomposition. The paper "Safety Aspects of Organic Peroxides in Bulk Tanks" by Jan J. de Groot, Dick M. Groothuizen and Jaap Verhoeff, "I & EC Process Design and Development", 1981, Vol. 20, pp. 131–138 (referred to as "Safety Aspects") discusses a tank designed for the bulk handling of diluted organic peroxides. The bulk storage tank in "Safety Aspects" is provided with a carbon rupture disk on top of the tank. During an accident in which the dilute organic peroxides explode, the rupture disk allows venting of the decomposition gases (and entrained liquid) to prevent bursting of the tank.

In U.S. Pat. No. 3,945,941, polyolefin particles, traps and/or liners are added to containers holding a mixture of 70% tertiary butyl hydroperoxide (TBHP) and 30% water. The polyolefin additives were found to inhibit rapid combustion of the TBHP mixture.

In Canadian Patent No. 1,148,334, disintegration or explosion barriers containing fillers such as "Pall" rings are used in processes for the distilling of ethylene oxide.

German Patent No. 149,086 discloses a container for holding hazardous liquids, such as petroleum and gasoline, which container is provided with a conduit having an inlet positioned near the bottom of the container. In case of a fire the liquid present in the container is pressed through said conduit into a closed overflow container which is provided at its top with a safety valve to allow for the escape of pressurized gases.

Currently available methods do not meet the needs of industry to safely store and transport bulk volumes of concentrated compounds liable to exothermic decomposition. Indeed, with currently available designs, decomposition and the resulting explosion and/or container rupture occur too quickly to safely reduce pressure by gas release and prevent explosion. Surprisingly, in view of the long felt need in the art, the container of the present invention provides pressure release which avoids explosion in the container.

The present invention relates to a container of the type indicated above and is characterized in that the conduit inlet is at or near the bottom of the container. Pressure inside such container is generated by the decomposition of liquid compounds liable to exothermic decomposition. When the pressure in the container reaches a certain predetermined pressure, the liquid release system is operated by the pressure in the container to discharge substantially all the liquid compound. By quickly releasing substantially all liquid from the container, explosion is avoided. The "predetermined, pressure" must be less than the maximum pressure rating of the container in order to maintain the structural integrity of the container. Generally, the maximum pressure rating of most industrial containers built for storage and/or transportation purposes is about 5 or 6 bars. However, containers having higher or lower maximum pressure ratings are not uncommon.

SUMMARY OF THE INVENTION

In one embodiment of the present invention, the explosion-safe liquid release system employs a dip pipe as the conduit. In accordance with the present invention, the inlet of the dip pipe is located at or near the bottom of the container. (Hereinafter, reference to "at the bottom of the container" means "at or near the bottom of the container.") If, due to the decomposition of the liquid, the pressure in the container increases to the predetermined design pressure, the liquid in the container is pushed out and explosion is avoided. The container may also contain inert particles. In another embodiment of the present invention, the conduit is an opening at the bottom of the container. A rupture disk is positioned at the inlet of the conduit, at the outlet of the conduit, or between the inlet and the outlet of the conduit. The rupture disk is set to burst at a predetermined pressure as defined above. If the pressure in the container reaches the predetermined pressure level, the rupture disk breaks, quickly releasing the liquid in the container and avoiding explosion. As in the previous embodiment, the container may also contain inert particles.

DETAILED DESCRIPTION OF THE INVENTION

Specific embodiments of the present invention are further described by reference to FIGS. 1 and 2.

Figure 1:
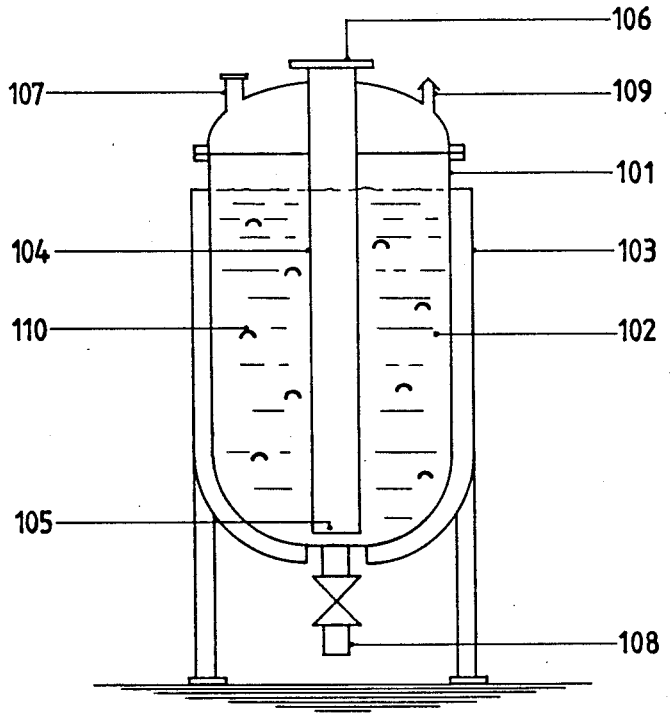
FIG. 1 is a representation of a container for storage or transportation of liquid compounds liable to exothermic decomposition, the container being equipped with an explosion-safe liquid release system comprised of a dip pipe having an inlet at the bottom of the container.

FIG. 1 is a representation of a container designed in accordance with the present invention. The particular embodiment illustrated in FIG. 1 may be referred to as the "dip pipe" release system. Container 101 holds a liquid 102 liable to exothermic decomposition. The size shape and construction material of container 101 will depend on factors such as intended use, liquid 102, and operating temperature and pressure. Liquid 102 may be diluted with a solvent or other liquid. Examples of such diluents for use with liquids liable to exothermic decomposition are water, hydrocarbons such as isododecane, esters such as dimethyl phthalate and mineral spirits such as methyl ethyl ketone. Additionally, liquid 102 may contain inert particles 110 such as Raschig rings, Solef balls, Berl saddles, Pall rings or other packing materials, preferably those made from inert materials such as glass, steel or olefins. Fitted in container 101 is a pressure-operated, explosion-safe liquid release system comprised of inlet 105, conduit 104 and outlet 106. If desired, a rupture disk may be installed at the inlet 105 or outlet 106 of the conduit 104 or in conduit 104 itself. Conduit 104 may be constructed of any material compatible with both the construction material of container 101 and the liquid 102. When liquid 102 is an organic peroxide, a preferred construction material for conduit 104 is stainless steel type AISI 316 or 304. The size of conduit 104 is dependent on the type, amount and concentration of liquid 102 and the maximum pressure rating of container 101. In general, the cross-sectional area ("A") of the conduit 104 should be about 0.005 $m^{-1}$to about 0.05 $m^{-1}$ of the container volume ("V") (where V is expressed in $m^3$). Typically, A is about 0.01 $m^{-1}$ to about 0.02 $m^{-1}$ of V. However, more violently decomposing liquids require a larger cross-sectional area.

With further reference to FIG. 1, container 101 is also equipped with a liquid inlet 107 for addition of liquid 102 to the container. To ensure proper operation of the liquid release system in the event that liquid inlet 107 is inadvertently left open, liquid inlet 107 should be small (less than about 1/10 cross-sectional area of conduit 104) and/or be fitted with a one-way "check" valve. Since container 101 is particularly designed as a reactor feed vessel it is also equipped with liquid removal line 108. Opening 109 is provided to equalize pressure inside and outside container 101 during filling and emptying of container 101. Opening 109 should be small (less than about 1/10 the cross-sectional area of conduit 104).

An additional feature illustrated in FIG. 1 but possible for any container of the current invention is cooling jack 103. Cooling jack 103 is particularly desirable when container 101 is used as a storage vessel or when container 101 is filled with a liquid which requires refrigeration.

Figure 2:
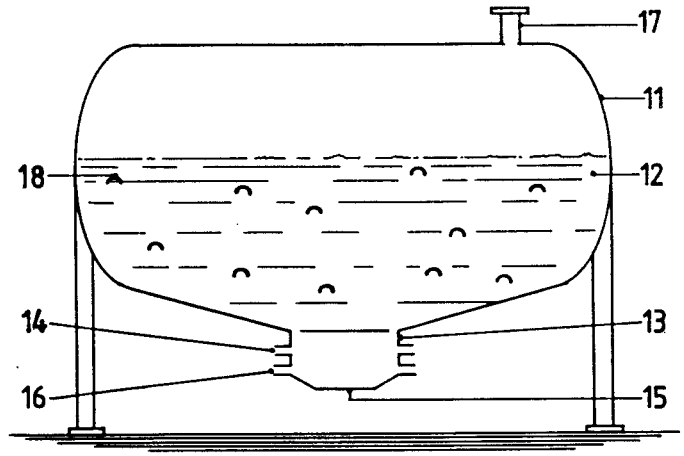
FIG. 2 is a cross-sectional representation of a container for storage or transportation of liquid compounds liable to exothermic decomposition, the container being equipped with an explosion-safe liquid release system comprised of a conduit having an inlet located at the bottom of the container and a rupture disk at the outlet of the conduit.

FIG. 2 is a cross-sectional view of another container designed in accordance with the present invention. Container 11 holds liquid 12 liable to exothermic decomposition. The size, shape and construction material of container 11 will depend on factors such as intended use, liquid 12, and operating temperature and pressure. Liquid 12 may be diluted with a solvent or other liquid as described above in relation to the embodiment in FIG. 1. Additionally, liquid 12 may contain inert particles 18, such as inert particles 110 also described in relation to FIG. 1. With further reference to FIG. 2, fitted at or near the bottom of container 11 is one embodiment of a pressure-operated, explosion-safe liquid release system comprised of conduit 13, inlet 14, rupture disk 15 and outlet 16. The size and release pressure of rupture disk 15 are determined based on criteria such as the type, amount, and concentration of liquid 12, the maximum pressure rating of the container, and the system operating temperature. Rupture disks of various sizes and bursting strength are available commercially from suppliers such as Berta under the tradename Fike®. The cross-sectional area of both conduit 13 and rupture disk 15 may be determined based on the guidelines discussed above for sizing conduit 104 in FIG. 1. The container of FIG. 2 is also fitted with liquid inlet 17. As in FIG. 1 the container represented in FIG. 2 may optionally contain liquid feed and removal lines, openings for pressure equalization, etc. based on the intended use of the container. Sizing such liquid feed and removal lines may be based on the guidelines discussed regarding liquid inlet 107 and opening 109 in FIG. 1.

The advantages of the present invention are demonstrated by the examples which follow. The maximum pressure rating for containers in Comparative Examples A–E and Examples 1–5 is approximately 6 bar. The examples are summarized in Table 1.

COMPARATIVE EXAMPLE A

A 20 liter aluminum container (0.3 m dia.×0.4 m) was constructed. The container was completely closed except for a 2 mm diameter opening in the top. Eighteen liters of tert.-butylperoxy-2-ethylhexanoate (technically pure) were placed in the container. The container was heated until peroxide decomposition was self-sustaining. The container pressure reached 17 bar and the container exploded. Explosion shock waves measured 1 bar overpressure at a distance of 1 m from the container and 0.2 bar overpressure at a distance of 2 m.

COMPARATIVE EXAMPLE B

An 8.3 liter (0.2 m dia.×0.25 m) stainless steel container was built with a 1.8 mm dia. relief opening and a 12 mm dia. opening in the top. Bis(3,5,5-trimethylhexanoyl) peroxide (6.7 liters of a 37.5% solution diluted with isododecane) was placed in the container. The container was heated until peroxide decomposition was self-sustaining. Decomposition gases were vented through the top opening. Nevertheless, the pressure inside the container reached the dangerous value of more than 13 bar, at which point part of the container wall broke.

COMPARATIVE EXAMPLE C

A test identical to Comparative Example B was carried out except the 12 mm opening was replaced by an 18 mm opening in the top of the container and the container was filled with Raschig rings. The container was heated until peroxide decomposition was self-sustaining. The internal pressure reached 1.7 bar.

COMPARATIVE EXAMPLE D

A test identical to Comparative Example C was carried out except the peroxide concentration was increased from 37.5% to 50%. The container was heated until peroxide decomposition was self-sustaining. The internal pressure reached 5.2 bar, at which point part of the container wall broke.

COMPARATIVE EXAMPLE E

An 8.3 liter stainless steel container (0.2 m dia.×0.25 m) was built with an 18 mm dia. conduit in the bottom and a 1 mm relief vent on top. Tert. butylperoxy pivalate (6.7 liter of a 75% solution diluted in isododecane) was placed in the container. The violence of decomposition of tert. butylperoxy pivalate is substantially equivalent to that of tert. butylperoxy-2-ethylhexanoate used in Comparative Example A. The container was heated to cause peroxide decomposition. Some peroxide was released through the conduit. However, the container internal pressure reached 7.8 bar at which point part of the container wall broke.

EXAMPLE 1

A test identical to Comparative Example B was carried out except the 12 mm dia.opening was replaced by a 12 mm dia. rupture disk in the bottom of the container. At an internal pressure of 0.5 bars, the rupture disk burst, releasing the container liquids and avoiding explosion. The internal pressure reached only 0 5 bar.

EXAMPLE 2

A test identical to Comparative Example E was performed except 90 Raschig rings (34 mm I.D., 40 mm O.D., 40 mm L) were placed in the container. The peroxide was heated and peroxide decomposition occurred. The container contents were released. The container internal pressure reached less than 0.05 bar. No explosion occurred.

EXAMPLE 3

A test identical to Example 2 was performed except 45 hollow spheres (type Solef PVDF, avoidable from Euromatic) of 38 mm diameter were floating on top of the peroxide. The container was filled with bis (3,5,5-trimethylhexanoyl)peroxide (6.7 liters of a 75% solution diluted with isododecane) and heated until peroxide decomposition occurred. The container contents were released. The container internal pressure reached less than 0.1 bar. No explosion occurred.

EXAMPLE 4

A 65 liter container (0.4 m dia.×0.6 m) constructed of stainless steel was built with a 22 mm dia. dip pipe substantially in accordance with the design of FIG. 1. The dip pipe inlet was located 11 mm from the bottom of the container. The dip pipe outlet was secured at the top of the container. The container was filled with 600 Raschig rings and 50 liter of a 75% tert.butyl peroxypivalate. The container was heated until peroxide decomposition was self-sustaining and liquid was released through the conduit. The internal pressure of the container reached 0.45 bar. No explosion occurred.

EXAMPLE 5

A test identical to Example 4 was performed except the container was filled with tert.-butyl peroxy-2-ethylhexanoate (rather than 75% buty perxoypivalate) and the top-mounted relief vent had a diameter of 2 mm. The container was heated to self-sustaining decomposition. The internal pressure reached a maximum of 0.42 bar. No explosion occurred.

TABLE 1

| Ex. | Container Vol. (L) | Container Dia. (M) | Liquid Component Liable to Decomposition | Diluent | Conduit Dia. (mm) | Conduit inlet Location | Relief vent Dia. (mm) | Particles | Maximum Pressure Measured (bar) | Explosion | Observations |
|---|---|---|---|---|---|---|---|---|---|---|---|
| A | 20 | 0.3 | tert.-butyl peroxy-2-ethylhexanoate | none | 2 | Top | 0 | none | 17 | Yes | Explosion Shock: 1 bar at 1m from container |
| B | 8.3 | 0.2 | 37.5% bis(3,5,5-trimethylhexanoyl) peroxide | isododecane | 12 | Top | 1.8 | none | 13+ | Yes | Container wall burst |
| C | 8.3 | 0.2 | 37.5% bis(3,5,5-trimethylhexanoyl) peroxide | isododecane | 18 | Top | 1.8 | Raschig rings | 1.7 | No | |
| D | 8.3 | 0.2 | 50% bis(3,5,5-trimethylhexanoyl) peroxide | isododecane | 18 | Top | 1.8 | Raschig rings | 5.2 | Yes | Container wall burst |
| E | 8.3 | 0.2 | 75% tert.-butyl peroxy pivalate | isododecane | 18 | Bottom | 1.0 | None | 7.8 | Yes | Container wall burst |
| 1 | 8.3 | 0.2 | 37.5% bis(3,5,5-trimethylhexanoyl) peroxide | isododecane | 12 | Bottom | 1.8 | None | 0.5 | No | Liquid release through conduit |
| 2 | 8.3 | 0.2 | 75% tert.-butyl peroxy pivalate | isododecane | 18 | Bottom | 1.0 | Raschig rings | 0.05 | No | Liquid release through conduit |
| 3 | 8.3 | 0.2 | 75% bis(3,5,5-trimethylhexanoyl peroxide) | isododecane | 18 | Bottom | 1.0 | Solef balls | 0.1 | No | Liquid release through conduit |
| 4 | 65 | 0.4 | 75% tert.-butyl peroxy | isododecane | 22 | Bottom | 3.0 | Raschig | 0.45 | No | Liquid |

TABLE 1-continued

| Ex. | Container Vol. (L) | Container Dia. (M) | Liquid Component Liable to Decomposition | Diluent | Conduit Dia. (mm) | Conduit inlet Location | Relief vent Dia. (mm) | Particles | Maximum Pressure Measured (bar) | Explosion | Observations |
|---|---|---|---|---|---|---|---|---|---|---|---|
| | | | pivalate | cane | | | | rings | | | release through conduit |
| 5 | 65 | 0.4 | tert.-butyl peroxy-2-ethylhexanoate | isododecane | 22 | Bottom | 2.0 | Raschig rings | 0.32 | No | Liquid release through conduit |

What we claimed is:

1. A container adapted for holding liquid compounds liable to exothermic decomposition, said container being provided with at least one explosion proof liquid release system comprising a conduit having an inlet and an outlet and a rupture disk positioned in said conduit, said liquid release system being operated by a pressure lower than the maximum pressure rating of said container, and said inlet of said conduit being positioned at the bottom of said container.

2. The container of claim 1 wherein said rupture disk is positioned at said outlet.

3. The container of claim 1 wherein said rupture disk is positioned in said conduit near said outlet.

4. The container of claim 1 wherein said rupture disk is the top of said container.

5. The container of claim 1 wherein said rupture disk is located near the top of said container.

6. The container of claim 1 wherein said container has a maximum pressure rating of about 6 bar.

7. The container of claim 1, wherein the cross-sectional area A of said conduit is about 0.005 $m^{-1}$ to about 0.05 $m^{-1}$ of the container volume V where V is expressed in $m^3$.

8. A method of storing or transporting a liquid liable to exothermic decomposition said method comprising use of a container holding both a liquid liable to exothermic decomposition and inert particles, said container having at least one explosion proof liquid release system comprising a conduit having an inlet and an outlet said inlet being positioned at the bottom of said container.

9. The method of claim 8 wherein said inert particles are selected from the group consisting of Raschig rings, Berl saddles, Pall rings and olefin particles.

10. The method of claim 8 wherein said liquid liable to exothermic decomposition is selected from the group consisting of organic peroxides, inorganic peroxides, azo compounds and mixtures thereof

11. The method of claim 8 wherein said container additionally holds at least one liquid diluent.

* * * * *

UNITED STATES PATENT AND TRADEMARK OFFICE

CERTIFICATE OF CORRECTION

PATENT NO. : 4,982,861

DATED : January 8, 1991

INVENTOR(S) : Johannes J. de Groot and Paul J. Sikkens

It is certified that error appears in the above-identified patent and that said Letters Patent is hereby corrected as shown below:

Column 7, lines 29-30, change "rupture disk is" to --outlet is located at--.

Column 8, line 24, add --,-- after "outlet".

Signed and Sealed this

Twenty-first Day of April, 1992

*Attest:*

HARRY F. MANBECK, JR.

*Attesting Officer*

*Commissioner of Patents and Trademarks*